US010426217B1

(12) United States Patent
Mainolfi et al.

(10) Patent No.: US 10,426,217 B1
(45) Date of Patent: Oct. 1, 2019

(54) FOOTWEAR WITH INTERCHANGEABLE SECTIONS

(71) Applicants: Domenick Mainolfi, Floral Park, NY (US); William O'Reilly, Mineola, NY (US)

(72) Inventors: Domenick Mainolfi, Floral Park, NY (US); William O'Reilly, Mineola, NY (US)

( * ) Notice: Subject to any disclaimer, the term of this patent is extended or adjusted under 35 U.S.C. 154(b) by 68 days.

(21) Appl. No.: 15/374,056

(22) Filed: Dec. 9, 2016

Related U.S. Application Data

(60) Provisional application No. 62/264,923, filed on Dec. 9, 2015.

(51) Int. Cl.
*A43B 3/24* (2006.01)
*A43B 21/36* (2006.01)
*A43B 17/02* (2006.01)

(52) U.S. Cl.
CPC ..... *A43B 3/24* (2013.01); *A43B 17/02* (2013.01); *A43B 21/36* (2013.01)

(58) Field of Classification Search
CPC ..... A43B 3/24; A43B 13/28; A43B 13/30; A43B 13/32; A43B 13/34; A43B 13/36; A43B 13/37; A43B 13/38; A43B 17/02; A43B 21/36
USPC ..... 36/100
See application file for complete search history.

(56) References Cited

U.S. PATENT DOCUMENTS 1,829,252 A * 10/1931 Zubia ..... A43B 21/36 36/42
1,829,253 A * 10/1931 Zubia ..... A43B 21/48 36/42
2,133,352 A * 10/1938 Jannings ..... A43B 13/34 36/149
2,873,540 A 2/1959 Venus
3,199,232 A * 8/1965 Pike ..... A43B 3/24 36/100
3,225,462 A * 12/1965 Lamberti ..... A43B 3/24 36/100
3,646,497 A * 2/1972 Gillikin ..... A43B 13/34 36/42
4,062,132 A 12/1977 Klimaszewski
4,363,177 A * 12/1982 Boros ..... A43B 21/39 36/101
5,373,649 A * 12/1994 Choi ..... A43B 21/37 36/36 R
5,477,625 A * 12/1995 Goldsmith ..... A43B 1/0054 36/100
5,692,322 A * 12/1997 Lombardino ..... A43B 3/24 36/100
5,765,295 A * 6/1998 Srourian ..... A43B 13/37 36/24.5
6,023,858 A * 2/2000 Srourian ..... A43B 3/24 36/11.5
7,168,184 B2 * 1/2007 Wallin ..... A43B 3/24 36/102

(Continued)

*Primary Examiner* — Anne M Kozak
(74) *Attorney, Agent, or Firm* — Cramer Patent & Design, PLLC; Aaron R. Cramer

(57) ABSTRACT

A shoe is bisected across the width thereof with each half capable of interlocking with the opposing half by means of intersecting prongs and prong receivers. A single insole is configured to cover the interlocking seem. Each shoe half comes in a variety of styles and shapes.

8 Claims, 8 Drawing Sheets

(56) References Cited

U.S. PATENT DOCUMENTS

| | | | | |
|---|---|---|---|---|
| 7,448,148 | B2 * | 11/2008 | Martinez | A43B 1/0054 36/102 |
| 7,461,470 | B2 * | 12/2008 | Dardinski | A43B 3/26 36/100 |
| 7,681,333 | B2 * | 3/2010 | Dardinski | A43B 3/26 36/100 |
| 8,069,583 | B1 * | 12/2011 | Simchuk | A43B 21/39 36/103 |
| 9,486,032 | B2 * | 11/2016 | Morris Thill | A43B 3/246 |
| 2001/0052195 | A1 * | 12/2001 | Blakey | A43B 3/24 36/100 |
| 2003/0097770 | A1 * | 5/2003 | Karasawa | A43B 3/06 36/97 |
| 2006/0048414 | A1 * | 3/2006 | Takada | A43B 13/189 36/93 |
| 2011/0179670 | A1 * | 7/2011 | Lepour | A43B 21/20 36/42 |
| 2011/0197474 | A1 * | 8/2011 | Mahmoud | A43B 3/246 36/100 |
| 2012/0174435 | A1 | 7/2012 | Cerdan et al. | |
| 2013/0067770 | A1 | 3/2013 | Sherwood et al. | |
| 2013/0247413 | A1 | 9/2013 | Cümbüs | |
| 2014/0033568 | A1 | 2/2014 | Pearson | |

* cited by examiner

FOOTWEAR WITH INTERCHANGEABLE SECTIONS

RELATED APPLICATIONS

The present invention was first described in and claims the benefit of U.S. Provisional Application No. 62/264,923 filed Dec. 9, 2015, the entire disclosures of which are incorporated herein by reference.

FIELD OF THE INVENTION

The present invention relates generally to the field of interchangeable footwear.

BACKGROUND OF THE INVENTION

Many people wear footwear to protect their feet and to provide fashion. Shoes, and more specifically the footwear worn by women, send a message about the wearer, the surrounding environment, and the general nature of the occasion for which the shoes are worn. For example, it is typical that footwear worn when a professional, business-like appearance is required has a closed toe and a heel. Footwear for evening and social events may have an open toe or sandal-like appearance and may have more colors and styles that may closely coordinate with the fashion of the wearer.

Footwear is a significant wardrobe investment, and often, the shoes may be suitable for wearing with only one outfit due to the style, color, and appearance of the garment. When the garment is no longer fashionable to wear, neither are the shoes, and the shoes must then be disposed of or stored in hopes of a new fashion to pair the footwear with. This can create challenges due to the expense of footwear and the need to find suitable storage, as footwear does not fold and stack as other clothing may be arranged for storage.

In some instances, a portion of the footwear may be salvageable to wear with additional fashions. For example, the heel portion may have color and structure that the wearer may wish to pair with additional fashions or work-wear, while the toe portion may not be preferred. It is a challenge to alter footwear for re-use for variable fashion trends and environments.

Various attempts have been made to solve problems found in interchangeable footwear art. Among these are found in: U.S. Pat. No. 7,591,084 to Santa Ana, U.S. Pat. No. 8,935,859 to Licht, U.S. Pat. No. 4,839,948 to Boros, U.S. Pat. No. 4,910,885 to Hsieh, U.S. Pat. No. 7,185,448 to Schupbach, and U.S. Pat. No. 8,112,908 to Visser. These prior art references are representative of reconfigurable footwear.

None of the above inventions and patents, taken either singly or in combination, is seen to describe the invention as claimed. Thus, a need exists for a reliable simplifier system, and to avoid the above-mentioned problems.

SUMMARY OF THE INVENTION

The inventor has recognized the aforementioned inherent problems and lack in the art and observed that there is a need for an expandable container.

It is therefore an object of the invention to provide an article of footwear, comprising a toe portion, a heel portion and a flap. The toe portion has a toe cap, secured to a first end of an upper surface of a toe plate and a plurality of prong receivers which are disposed in a first array within a second end of the toe plate. The heel portion which has a heel back which is secured to a first end of an upper surface of a heel plate, a heel stem secured to a lower surface of the heel plate and a plurality of prongs projecting away from the heel plate and disposed in a second array along a second end. The flap is capable of removably covering the upper surface of the toe plate and the heel plate while being coextensive with the width of the toe plate and the heel plate. The plurality of prongs is capable of being removably secured within the plurality of receivers thereby securing the toe portion to the heel portion. In a separate embodiment, the flap may be secured to the upper surface of the toe plate while being coextensive with and extending a length of the upper surface of the heel plate and coextensive with a width of the toe plate and the heel plate.

Each prong receiver may comprise of a square shaped opening which may accommodate each prong having a lengthened pyramid shape with a sharp distal end or a flat end. Each prong receiver may also comprise of a circular-shaped opening which may accommodate each prong having a lengthened cone shape with a sharp distal end or a flat end.

The heel stem may comprise of a rectangular tube or a wedge having a first fixing surface secured to a distal end of an upper face of the wedge. When the heel stem comprises a wedge the toe plate may comprise a second fixing element which is secured to a lower face of the toe plate. In this embodiment, the first fixing element is capable of being removably secured to the second fixing element thereby removably securing the toe plate to the wedge.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
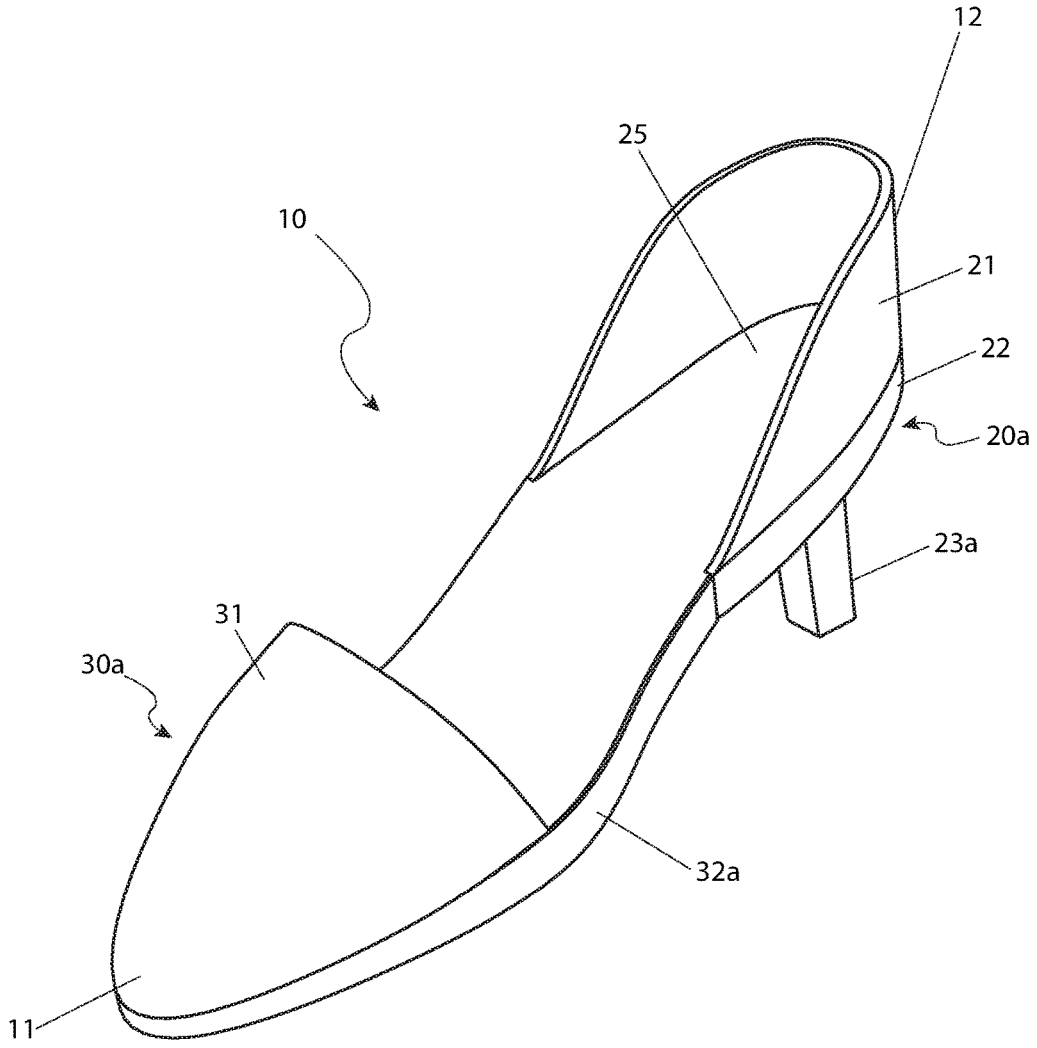
FIG. 1 is a perspective view of an article of footwear 10 showing a heel portion 20*a* assembled with a toe portion 30*a*, according to the preferred embodiment of the present invention.

10 footwear
11 footwear first end
12 footwear second end
13 footwear third end
14 footwear fourth end
20*a* heel portion first embodiment
20*b* heel portion second embodiment
20*c* heel portion third embodiment
20*d* heel portion fourth embodiment
20*e* heel portion fifth embodiment
21 heel back
22 heel plate
23*a* heel stem first embodiment
23*b* heel stem second embodiment
24*a* prong first embodiment
24*b* prong second embodiment
24*c* prong third embodiment
24*d* prong fourth embodiment
25 flap
30*a* toe portion first embodiment
30*b* toe portion second embodiment
30*c* toe portion third embodiment
31 toe cover
32*a* toe plate first embodiment
32*b* toe plate second embodiment
32*c* toe plate second embodiment
34*a* prong receiver first embodiment
34*b* prong receiver second embodiment
35 first fixing surface
36 second fixing surface

DETAILED DESCRIPTION OF THE PREFERRED EMBODIMENT

The present invention is directed to an article of footwear 10. In one (1) embodiment of, the footwear 10 may comprise reconfigurable portions 20, 30 to adapt to a plurality of fashions and wearing environments, having a heel portion 20 and a toe portion 30 capable of assembly, and a leather-like lining flap 25.

Figure 2A:
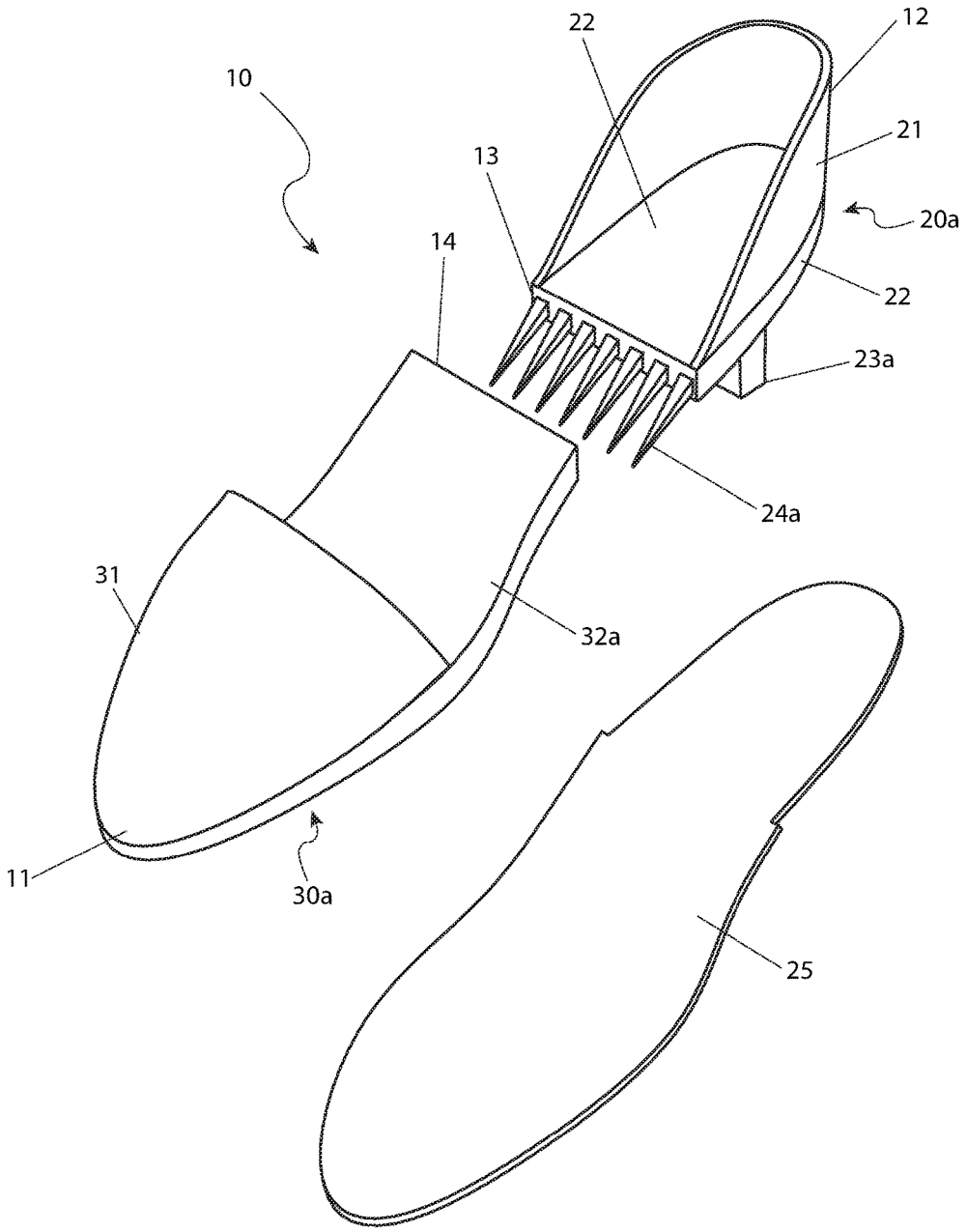
FIG. 2*a* is a perspective view illustrating the footwear 10 comprising the heel portion 20*a*, toe portion 30*a* and disassembled flap portion 25, according to the preferred embodiment of the present invention.
Figure 2B:
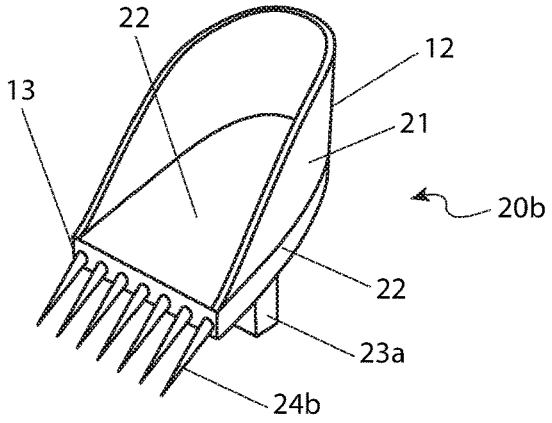
FIG. 2*b* is a perspective view illustrating the heel portion 20*b*, according to an alternate embodiment of the present invention.
Figure 2C:
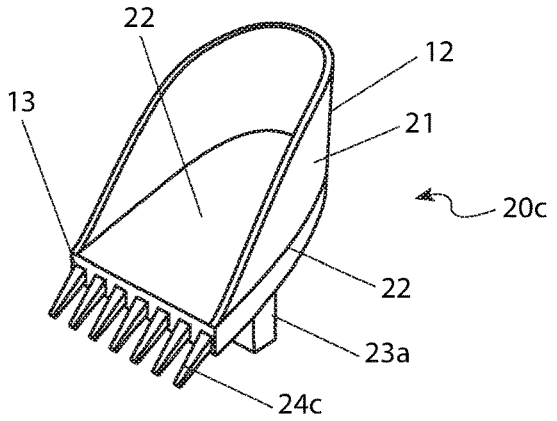
FIG. 2*c* is a perspective view illustrating the heel portion 20*c*, according to an alternate embodiment of the present invention.
Figure 2D:
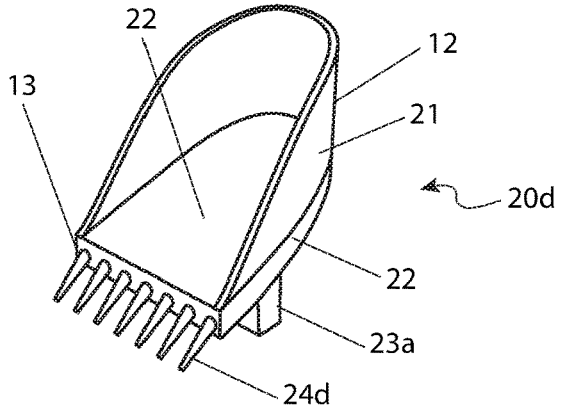
FIG. 2*d* is a perspective view illustrating the heel portion 20*d* according to an alternate embodiment of the present invention.
Figure 3:
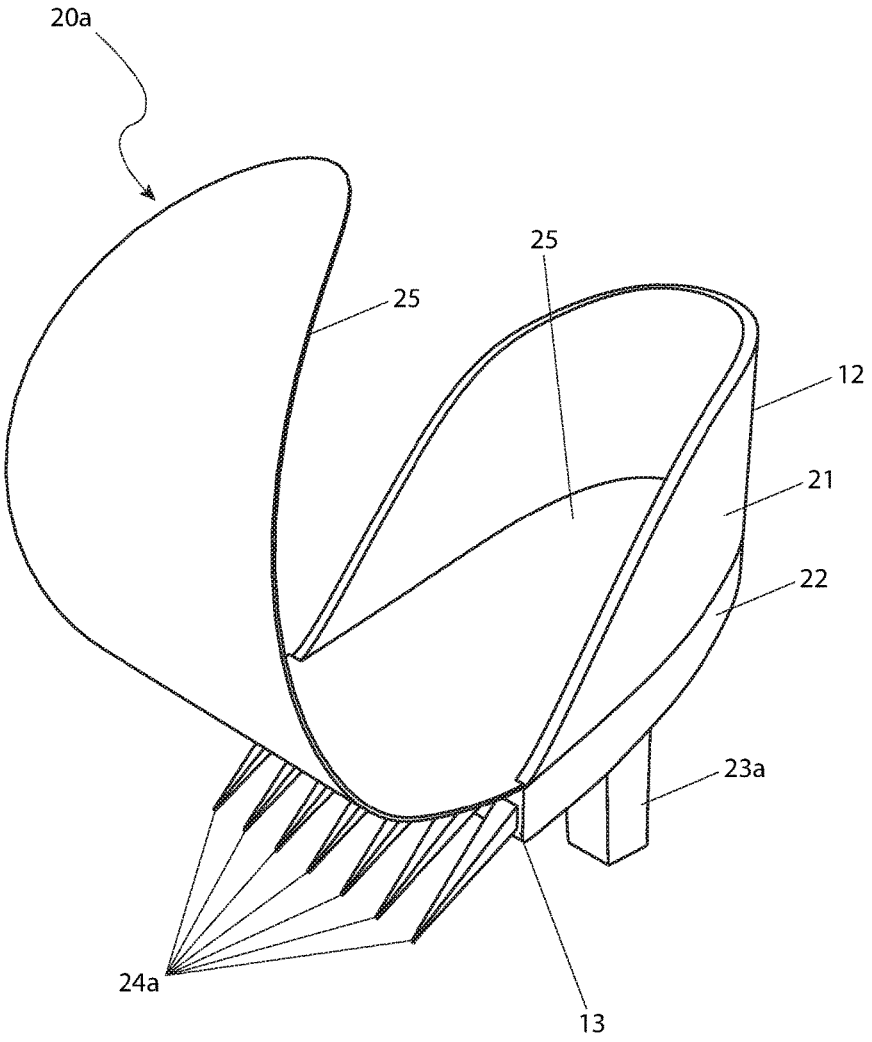
FIG. 3 is a perspective view illustrating the heel portion 20*a* with assembled flap portion 25, according to the preferred embodiment of the present invention.
Figure 4A:
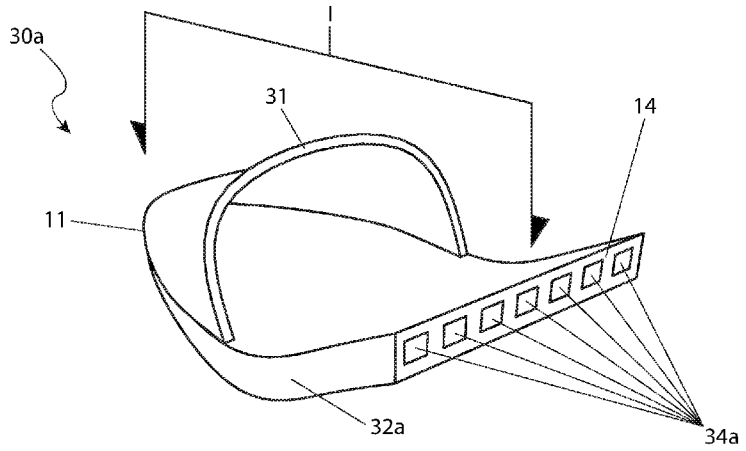
FIG. 4*a* is a perspective view illustrating the toe portion 30*a*, according to the preferred embodiment of the present invention.
Figure 4B:
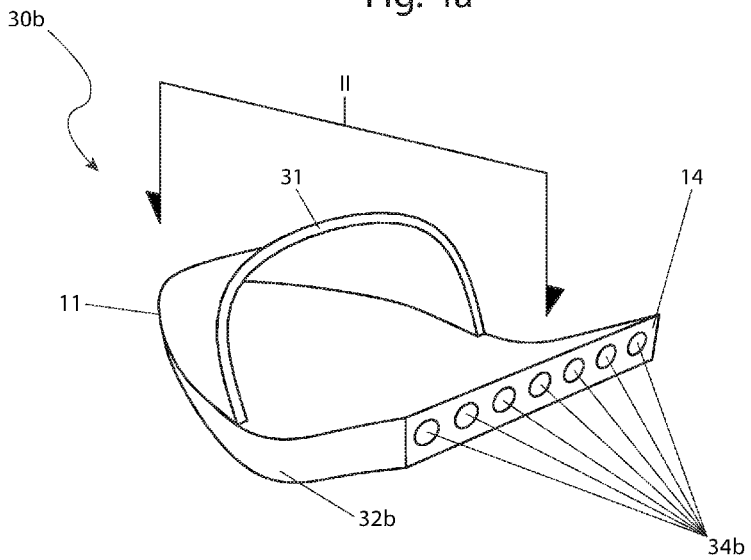
FIG. 4*b* is a perspective view illustrating the toe portion 30*b*, according to an alternate embodiment of the present invention.
Figure 5:
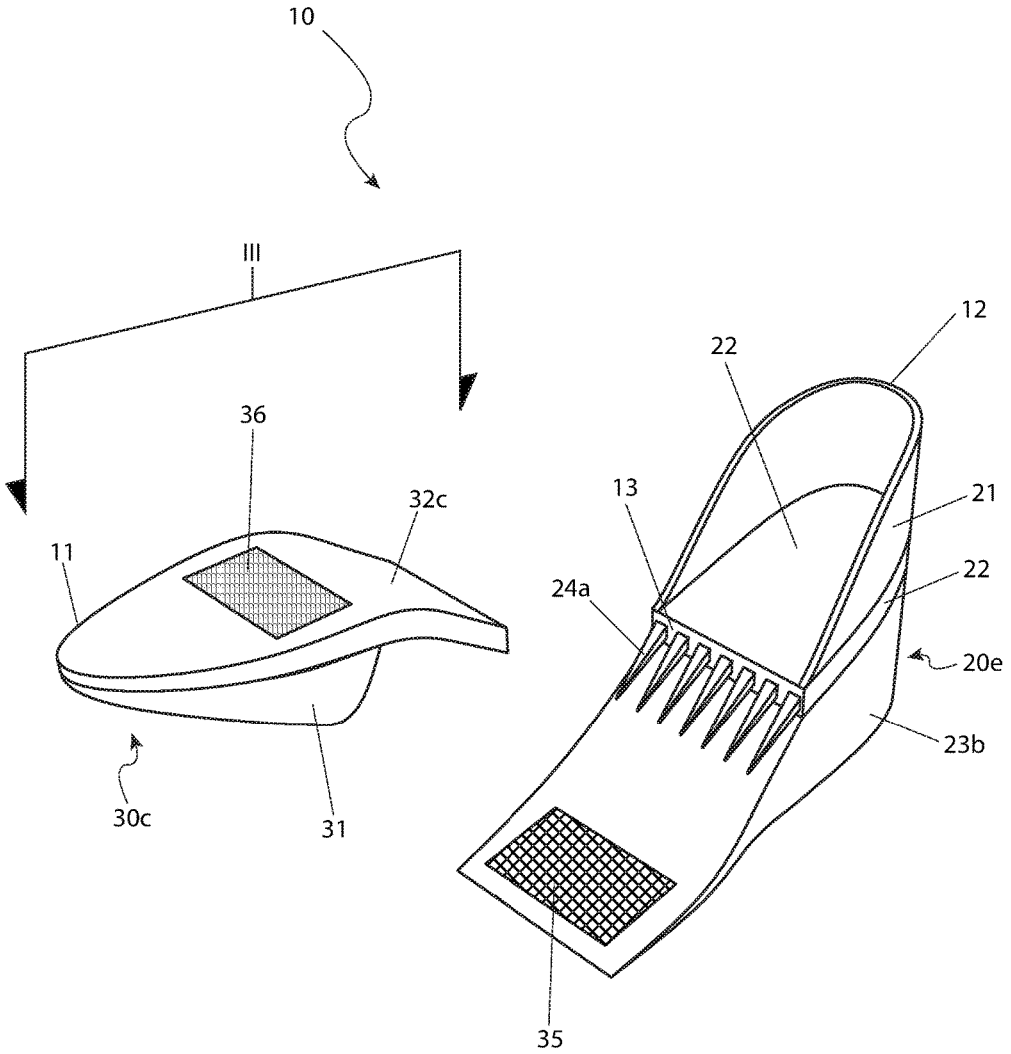
FIG. 5 is a perspective view illustrating the disassembled footwear 10 comprising the heel portion 20*e*, toe portion 30*c*, according to an alternate embodiment of the present invention.
Figure 6:
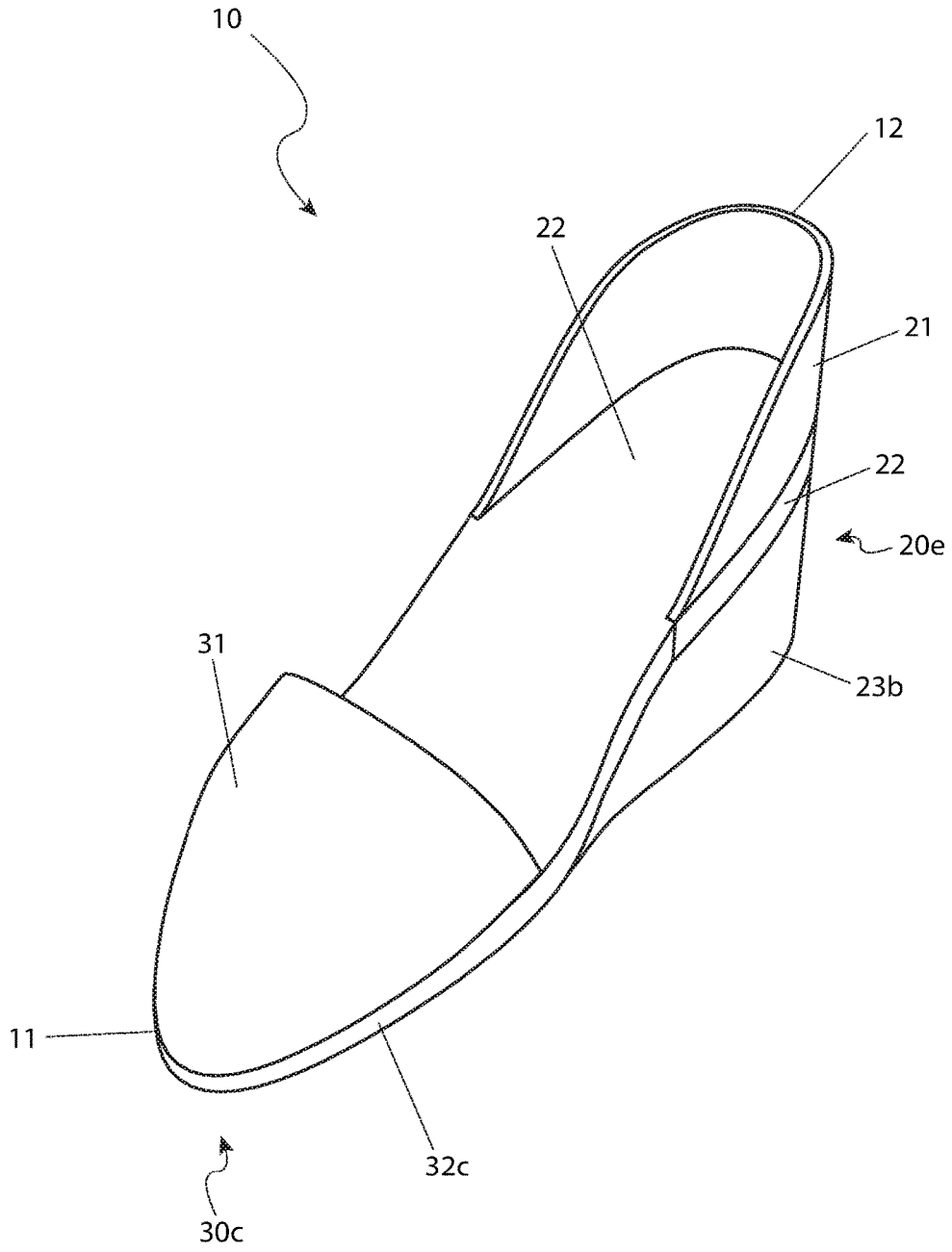
FIG. 6 is a perspective view illustrating the assembled footwear 10, according to an embodiment of the present invention.
Figure 7:
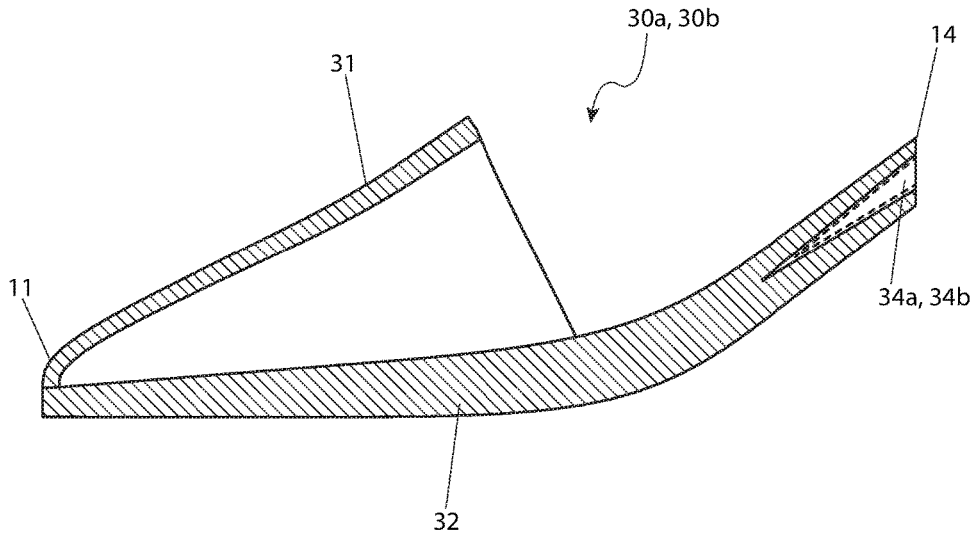
FIG. 7 is a cross-section view of FIG. 4*a* and FIG. 4*b*, taken along line I and II respectively illustrating the toe portion 30*a*, according to the preferred embodiment of the present invention and 30*b*, according to an alternate embodiment of the present invention; and, FIG. 8 is a cross-section view of FIG. 5, taken along line III illustrating the toe portion 30*c*, according an alternate embodiment of the present invention.
Figure 8:
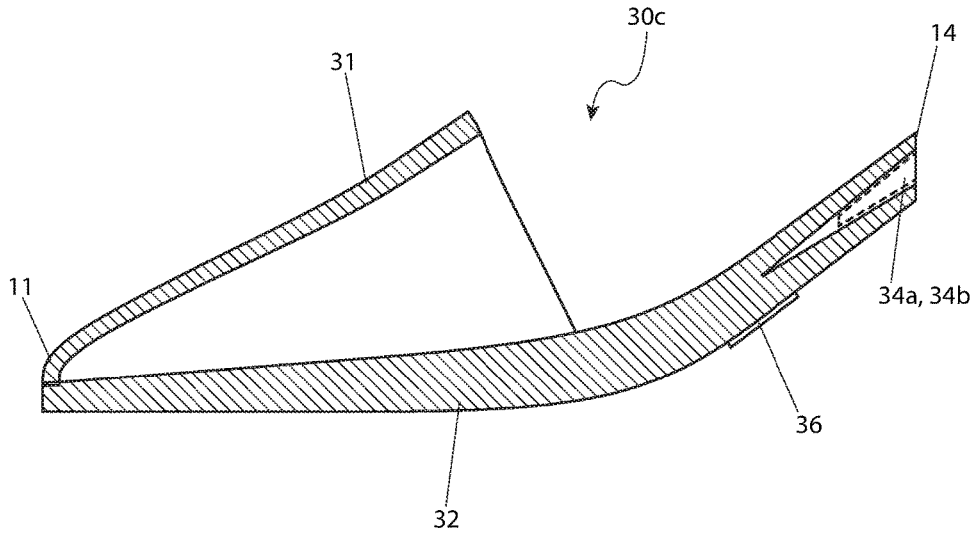

Referring now to the drawings FIG. 1 is a perspective view of an article of footwear 10 showing a heel portion 20*a* assembled with a toe portion 30*a*, according to the preferred embodiment of the present invention; FIG. 2*a* is a perspective view illustrating the footwear 10 comprising the heel portion 20*a*, toe portion 30*a* and disassembled flap portion 25, according to the preferred embodiment of the present invention; FIG. 2*b* is a perspective view illustrating the heel portion 20*b*, according to an alternate embodiment of the present invention; FIG. 2*c* is a perspective view illustrating the heel portion 20*c*, according to an alternate embodiment of the present invention; FIG. 2*d* is a perspective view illustrating the heel portion 20*d* according to an alternate embodiment of the present invention; FIG. 3 is a perspective view illustrating the heel portion 20*a* with assembled flap portion 25, according to the preferred embodiment of the present invention; FIG. 4*a* is a perspective view illustrating the toe portion 30*a*, according to the preferred embodiment of the present invention; FIG. 4*b* is a perspective view illustrating the toe portion 30*b*, according to an alternate embodiment of the present invention; FIG. 5 is a perspective view illustrating the disassembled footwear 10 comprising the heel portion 20*e*, toe portion 30*c*, according to an alternate embodiment of the present invention; FIG. 6 is a perspective view illustrating the assembled footwear 10, according to an embodiment of the present invention; FIG. 7 is a cross-section view of FIG. 4*a* and FIG. 4*b*, taken along line I and II respectively illustrating the toe portion 30*a*, according to the preferred embodiment of the present invention and 30*b*, according to an alternate embodiment of the present invention; and, FIG. 8 is a cross-section view of FIG. 5, taken along line III illustrating the toe portion 30*c*, according an alternate embodiment of the present invention.

Referring now to the drawings, there is shown in FIG. 1 an article of footwear 10 in the preferred embodiment that comprises two (2) parts, a heel portion 20*a* and a toe portion 30*a*, that may be functionally joined in a plurality of combinations having a footwear first end 11, a footwear second end 12. The heel portion 20*a* has a heel back 21 circumferentially secured about an exterior top face edge of a heel plate 22 and a heel stem 23*a* secured subjacent the heel plate 22. The toe portion 30*a* has a toe cover 31 secured circumferentially about an exterior top face edge of a toe plate 32*a*. A flap 25 extends away from the heel plate 22 and is sized to encompass the entire width of the heel plate 22 and toe plate 32*a* top surface when the heel portion 20*a* and toe portion 30*a* are conjoined. The flap 25 may be structured and arranged to conform to a foot bed of the footwear 10 when the heel portion 20*a* and the toe portion 30*a* are in a joined condition. The flap 25 may support the foot of a wearer. The flap 25 may also prevent potential discomfort for the wearer at the seam between the heel portion 20*a* and toe portion 30*a* by providing a cushioning function between the foot of the wearer and the footwear 10. The exact specifications, materials used, and method of use of the footwear 10 may vary upon manufacturing. The flap 25 may be utilized in the manner previously described for the footwear preferred embodiment 10 or any alternate embodiment discussed more fully below.

Referring now to FIG. 2*a*, showing the footwear 10 in a disassembled manner comprising the heel portion 20*a*, toe portion 30*a* and flap portion 25. The heel portion 20*a*, which may comprise a plurality of prongs 24*a* extending across a majority of the heel plate 22*a* of the heel portion 20*a*, may be removably coupled to the toe portion 30*a* through a friction fit insertion into a corresponding plurality of prong receivers 34*a*, 34*b* (please see FIGS. 4*a* and 4*b*) extending across a majority of the toe plate 32*a* of the toe portion 30*a*. The plurality of prongs 24*a* are of uniform structure and size that may be suitable for engaging with a toe portion 30*a* having prong receivers 34*a*, 34*b*. The plurality of prongs 24*a* are located on a footwear third end 13 of the heel plate 22*a* and the prong receivers 34*a*, 34*b* are located on a footwear fourth end 14 of the toe plate 32*a*.

When coupled, the heel portion 20*a* and the toe portion 30*a* may comprise a functional article of footwear 10 useful for coordinating with a plurality of fashions and wearing environments. The heel portion 20*a* and the toe portion 30*a* may comprise coordinated colors, materials and styles which may be interchangeably joined to create a plurality of shoe fashions and configurations. The heel portion 20*a* may also comprise a leather-type lining flap 25 affixed to an upper surface of the heel plate 22*a* and also the heel back 22 in certain embodiments (please see FIG. 3).

Referring again to FIG. 2*a*, each prong 24*a* comprises a lengthened pyramid having a sharp distal end. FIG. 2*b* demonstrates a heel portion 20*b* in a second embodiment having a plurality of prongs 24*b* which comprise a lengthened cone having a sharp distal end. FIG. 2*c* demonstrates a heel portion 20*c* in a third embodiment having a plurality of prongs 24*c* which comprise a lengthened pyramid having a flat or blunted distal end. FIG. 2*d* demonstrates a heel portion 20*d* in a fourth embodiment having a plurality of prongs 24*d* which comprise a lengthened cone having a flat or blunted distal end. The square base of the plurality of prongs 24*a*, 24*c* necessitate coupling with square-shaped prong receivers 34*a* (please see FIG. 4*a*). The circular base of the plurality of prongs 24*b*, 24*d* necessitate coupling with circular shaped prong receivers 34*b* (please see FIG. 4*b*).

Referring now to FIG. 5, a heel portion 20*e* in a fifth embodiment is demonstrated. The heel portion 20*e* has a wedge-shaped heel stem 23*b* with a first fixing element 35 secured to the distal end of the upper face of the heel stem 23*b*. A corresponding toe portion 30*c* in a third embodiment has a second fixing element 36 secured to centrally located region on the bottom of the toe plate 32*c*. The fixing elements 35, 36 may comprise any temporary fixing means such as corresponding hook and loop material or magnets. When properly joined together the heel portion 20*e* and toe portion 30*c* present a footwear 10 commonly known as a wedge shoe. When so joined, the interaction of the fixing elements 35, 36 assist in removably securing the toe plate 32*c* to the heel plate 23*b*. See FIG. 6.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. An article of footwear, comprising:

a toe portion comprising:

a toe cover secured to a first end of an upper surface of a toe plate; and, a plurality of prong receivers disposed in a first array across a majority of a width of said toe plate and along a second end of said toe plate;

a heel portion comprising:

a heel back secured to a first end of an upper surface of a heel plate;

a heel stem secured to a lower surface of said heel plate; and, a plurality of prongs projecting away from said heel plate and disposed in a second array across a majority of a width of said heel plate and along a second end thereof; and, a flap removably covering said upper surface of said toe plate and said heel plate and coextensive with a width of said toe plate and said heel plate;

wherein said plurality of prongs is capable of being removably secured within said plurality of receivers thereby securing said toe portion to said heel portion;

wherein each prong receiver comprises a square-shaped opening; and wherein each prong comprises a lengthened pyramid having a sharp distal end.

2. The article of footwear of claim 1, wherein said heel stem comprises a rectangular tube.

3. The article of footwear of claim 1, wherein said heel stem comprises a wedge having a first fixing surface secured to a distal end of an upper face of said wedge.

4. The article of footwear of claim 3, wherein said toe plate comprises a second fixing element secured to a lower face of said toe plate;

wherein said first fixing element is capable of being removably secured to said second fixing element thereby removably securing said toe plate to said wedge.

5. An article of footwear, comprising:

a toe portion comprising:

a toe cover secured to a first end of an upper surface of a toe plate; and, a plurality of prong receivers disposed in a first array across a majority of a width of said toe plate and along a second end of said toe plate;

a heel portion comprising:

a heel back secured to a first end of an upper surface of a heel plate;

a heel stem secured to a lower surface of said heel plate; and, a plurality of prongs projecting away from said heel plate and disposed in a second array across a majority of a width of said heel plate and along a second end thereof; and, a flap secured at a first end to said upper surface of said heel plate coextensive with and extending a length of said upper surface of said heel plate and coextensive a width of said toe plate and said heel plate;

wherein said plurality of prongs is capable of being removably secured within said plurality of receivers thereby securing said toe portion to said heel portion;

wherein each prong receiver comprises a square-shaped opening; and wherein each prong comprises a lengthened pyramid having a sharp distal end.

6. The article of footwear of claim 5, wherein said heel stem comprises a rectangular tube.

7. The article of footwear of claim 5, wherein said heel stem comprises a wedge having a first fixing surface secured to a distal end of an upper face of said wedge.

8. The article of footwear of claim 7, wherein said toe plate comprises a second fixing element secured to a lower face of said toe plate;

wherein said first fixing element is capable of being removably secured to said second fixing element thereby removably securing said toe plate to said wedge.

* * * * *